US009903260B2

(12) United States Patent
Hosokawa

(10) Patent No.: US 9,903,260 B2
(45) Date of Patent: Feb. 27, 2018

(54) APPARATUS AND METHOD FOR DETERMINING PORE CLOGGING IN ENGINE COOLING SYSTEM

(71) Applicant: TOYOTA JIDOSHA KABUSHIKI KAISHA, Toyota-shi, Aichi-ken (JP)

(72) Inventor: Yohei Hosokawa, Susono (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 149 days.

(21) Appl. No.: 14/951,991

(22) Filed: Nov. 25, 2015

(65) Prior Publication Data

US 2016/0153345 A1 Jun. 2, 2016

(30) Foreign Application Priority Data

Dec. 1, 2014 (JP) ..... 2014-243387

(51) Int. Cl.
*G01M 15/00* (2006.01)
*F01P 11/14* (2006.01)

(52) U.S. Cl.
CPC ..... *F01P 11/14* (2013.01); *F01P 2031/18* (2013.01)

(58) Field of Classification Search
CPC .... F01P 11/14; F01P 2031/18; F01P 2031/00; G01M 15/09
USPC ..... 73/114.68
See application file for complete search history.

(56) References Cited

U.S. PATENT DOCUMENTS 8,881,693 B2 * 11/2014 Hayashi ..... F01P 7/167 123/41.01
2013/0030643 A1 * 1/2013 Nishizawa ..... F01P 5/14 701/32.8

FOREIGN PATENT DOCUMENTS

| | | |
|---|---|---|
| EP | 2 863 030 A1 | 4/2015 |
| JP | 2015-222047 | 12/2015 |
| WO | WO 2013/190619 A1 | 12/2013 |
| WO | WO 2014/178111 A1 | 11/2014 |

* cited by examiner

*Primary Examiner* — Walter L Lindsay, Jr.
*Assistant Examiner* — Ruth Labombard
(74) *Attorney, Agent, or Firm* — Finnegan, Henderson, Farabow, Garrett & Dunner, LLP

(57) ABSTRACT

The pore clogging determination apparatus tentatively determines clogging of a pore (micropore) based on the rate of increase in a coolant temperature at an engine outlet. When the presence of pore clogging has been tentatively determined, the apparatus increases a rotation speed of a coolant pump to determine whether or not the coolant pump is idling. When it has been determined that the coolant pump is idling, the apparatus finalizes the determination of the clogging of the pore (micropore). This suppresses an erroneous determination of clogging of the pore that allows the coolant to flow in an engine cooling system.

3 Claims, 4 Drawing Sheets

APPARATUS AND METHOD FOR DETERMINING PORE CLOGGING IN ENGINE COOLING SYSTEM

PRIORITY INFORMATION

This application claims priority to Japanese Patent Application No. 2014-243387 filed on Dec. 1, 2014, which is incorporated herein by reference in its entirety.

TECHNICAL FIELD

The present invention relates to a structure of an apparatus and a method for determining pore clogging in an engine cooling system.

BACKGROUND ART

An engine has a cooling apparatus for maintaining an engine temperature at an appropriate operating temperature. Commonly used cooling apparatuses include the apparatus that, by using a radiator, cools a coolant having a temperature that has increased inside the engine, and circulates the coolant through the engine, thereby cooling the engine. Such a cooling apparatus uses a method that does not circulate the coolant at the time of a cold start where the engine temperature is low, and circulates the coolant, when the engine temperature increases to a predetermined temperature. However, when no coolant flows inside the engine immediately after the cold start of the engine, a temperature distribution may occur inside the engine, leading to a stress or the like. Therefore, even when the engine temperature is low and the engine is not cooled by circulating the coolant, a very small amount of coolant is often allowed to flow inside the engine to avoid large unevenness in the temperature at various parts in the engine. For this purpose, a very small pore or a notch that allows the coolant to flow is often provided in a valve body in the cooling system.

In a cooling system with such a configuration, when the coolant does not flow due to foreign matter clogged in the pore or the notch, temperature unevenness may occur in the engine, leading to an increased stress and a reduced lifetime. Therefore, there has been proposed a method for estimating and determining clogging of the pore or the notch based on a difference in the coolant temperatures detected at different positions. In this case, one coolant temperature sensor is provided at an engine outlet and another one is provided in a bypass passage that bypasses the engine (for example, refer to WO 2013-150619).

Meanwhile, when no coolant has been injected in a cooling passage, or air remains in the cooling passage immediately after injection of the coolant, the cooling passage is not filled with the coolant. This may cause a failure in circulating the coolant by a coolant pump, and then the degree of increase in the coolant temperature at an engine outlet may be similar to a case when, there is clogging of a pore or a notch, leading to an erroneous determination of clogging of the pore or the notch.

Therefore, an object of the present invention is to suppress an erroneous determination of clogging of a pore that allows the coolant to flow in an engine cooling system.

SUMMARY

A pore clogging determination apparatus according to an embodiment of the present invention is used in an engine cooling system. The engine cooling system includes: a first cooling passage passing through the inside of an engine; a second cooling passage branching from the first cooling passage and bypassing the engine; a coolant pump controlled by a command from an ECU and configured to circulate a coolant in the first and second cooling passages; a connection passage connecting an engine outlet of the first cooling passage to the second cooling passage; a switching valve disposed in the connection passage, configured to open and close the connection passage, and including a pore that allows the coolant to flow through the connection passage; and a first temperature sensor configured to detect a coolant temperature at the engine outlet. The pore clogging determination apparatus includes a CPU and is connected to the ECU. The CPU tentatively determines clogging of the pore based on the degree of increase in the coolant temperature at the engine outlet, the coolant temperature being detected by the first temperature sensor at a cold start of the engine. Upon tentatively determining the pore clogging, the CPU outputs, to the ECU, a command for increasing a rotation speed of the coolant pump to increase the rotation speed of the coolant pump. With the above state, the CPU determines the presence or absence of idling in the coolant pump. Upon determining that no idling is present in the coolant pump, the CPU executes a process of finalizing the determination of the pore clogging.

In the pore clogging determination apparatus according to an embodiment of the present invention, the CPU preferably determines that the coolant pump is idling when an actual rotation speed of the coolant pump obtained by a rotation speed sensor is higher than a target rotation speed obtained from the ECU, and a difference between the two exceeds a predetermined value.

A pore clogging determination method according to an embodiment of the present invention is used in am engine cooling system. The engine cooling system includes: a first cooling passage passing through the inside of an engine; a second cooling passage branching from the first cooling passage and bypassing the engine; a coolant pump configured to circulate a coolant in the first and second cooling passages; a connection passage connecting an engine outlet of the first cooling passage to the second cooling passage; a switching valve disposed in the connection passage, configured to open and close the connection passage, and including a pore that allows a very small amount of coolant to flow through the connection passage; and a first temperature sensor configured to detect a coolant temperature at the engine outlet. The pore clogging determination method includes: a tentative determination step of tentatively determining clogging of the pore based on the degree of increase in the coolant temperature at the engine outlet, the coolant temperature being detected by the first temperature sensor at a cold start of the engine; an idling determination step of outputting a command to increase a rotation speed of the coolant pump and determining the presence or absence of idling in the coolant pump when the pore clogging has been tentatively determined at the tentative determination step; and a pore clogging finalization step of finalizing the determination of the pore clogging when it has been determined in the idling determination step that the coolant pump is not idling.

Advantages of the Invention

The present invention is effective in suppressing an erroneous determination of clogging of a pore that allows the coolant to flow in an engine cooling system.

DESCRIPTION OF EMBODIMENTS

Figure 1:
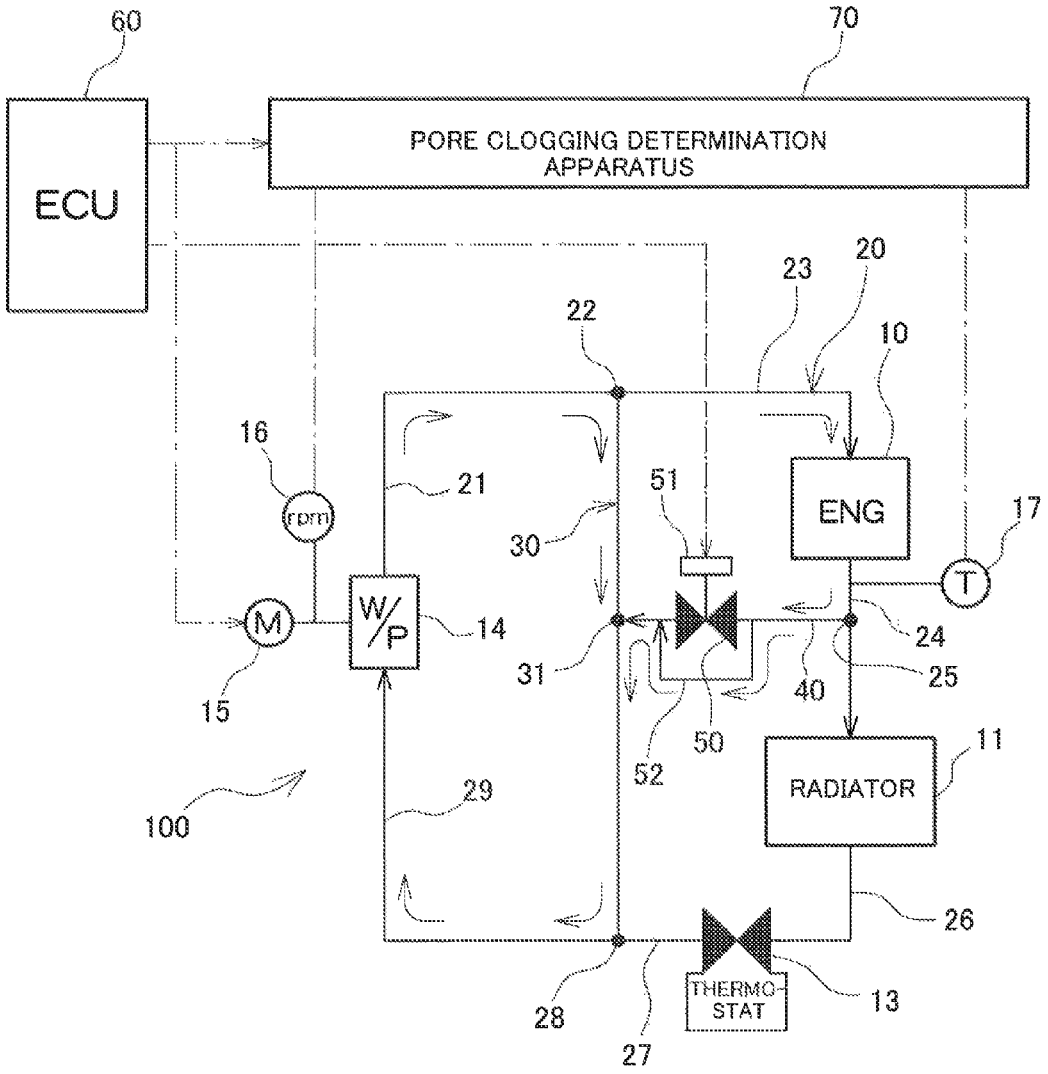
FIG. 1 is a system diagram illustrating configurations of a pore clogging determination apparatus and an engine cooling system according to an embodiment of the present invention.

Hereinafter, a pore clogging determination apparatus 70 of the present embodiment will be described with reference to the drawings. First, an engine cooling system 100 to which the pore clogging determination apparatus 70 of the present embodiment is applied will be described with reference to FIG. 1. As illustrated in FIG. 1, the engine cooling system 100 includes a first cooling passage 20 that passes through the inside of an engine 10, a second cooling passage 30 that bypasses the engine 10, and a coolant pump 14 that circulates a coolant in the first and second cooling passages 20 and 30.

The coolant pump 14, the engine 10, a radiator 11, and a thermostat 13 are connected in series in this order to the first cooling passage 20 from upstream. The engine 10 has a cooling passage therein and is cooled by the coolant. The radiator 11 cools the coolant having a temperature that has increased inside the engine 10. The thermostat 13 opens and closes a flow of the coolant in the first cooling passage 20 depending on the coolant temperature. A first branch point 22 and a second branch point 28 are connected via the second cooling passage 30 that bypasses the engine 10. The first branch point 22 exists between the engine 10 and the coolant pump 14 in the first cooling passage 20. The second branch point 28 exists between the thermostat 13 and the coolant pump 14. A third branch point 25 and a fourth branch point 31 are connected via a connecting pipe 40. The third branch point 25 exists at an engine outlet pipe 24 in the first cooling passage 20. The fourth branch point 31 exists between the first branch point 22 in the second cooling passage 30 and the second branch point 28. A switching valve 50 is attached to the connecting pipe 40 and opens or closes the coolant flow in the connecting pipe 40. An electromagnetic actuator controls open/close operations of the switching valve 50. FIG. 1 schematically illustrates an electromagnetic actuator 51. A pore (micropore) 52 is provided at a center of a valve body of the switching valve 50 to allow the coolant to flow through the inside thereof even when the valve is in a closed state. FIG. 1 schematically illustrates the pore (micropore) 52 as a pipe that bypasses the switching valve 50. Note that the thermostat 13 and the switching valve 50 illustrated in FIG. 1 both indicate the closed states thereof when the engine 10 is undergoing a cold start. The coolant pump 14 is driven by the electrical power of a motor 15. A rotation speed sensor 16 that detects a rotation speed of the motor 15 is attached to the coolant pump 14. Further, a temperature sensor 17 that detects the coolant temperature at an engine outlet is attached to the engine outlet pipe 24 of the first cooling passage 20.

The pore clogging determination apparatus 70 is a computer that includes a CPU and a storage unit therein. The temperature sensor 17 and the rotation speed sensor 16 are connected to the apparatus. The data detected, by each sensor is input to the pore clogging determination apparatus 70. Also, the motor 15 that drives the coolant pump 14, and the electromagnetic actuator 51 for the switching valve 50, are connected to an ECU 60 that controls overall operations of the engine 10, independent of the pore clogging determination apparatus 70. A rotation speed command signal or a motor drive duty ratio signal for the motor 15 is input from the ECU 60 to the pore clogging determination apparatus 70.

When the ECU 60 starts the engine 10 in the state illustrated in FIG. 1, the ECU 60 simultaneously starts the motor 15 that drives the coolant pump 14, thereby starting the coolant pump 14. At this time, the thermostat 13 and the switching valve 50 are each closed. Accordingly, the coolant circulates as indicated by arrows in FIG. 1, in the order of the coolant pump 14, a discharge pipe 21, the first branch point 22, an engine inlet pipe 23, the engine 10, the engine outlet pipe 24, the third branch point 25, the pore (micropore) 52, the fourth branch point 31, the second branch point 28, and returns to the coolant pump 14. Simultaneously, the coolant circulates while bypassing the engine 10, in the order of the coolant pump 14, the first branch point 22, the second branch point 28, and back to the coolant pump 14.

Figure 2A:
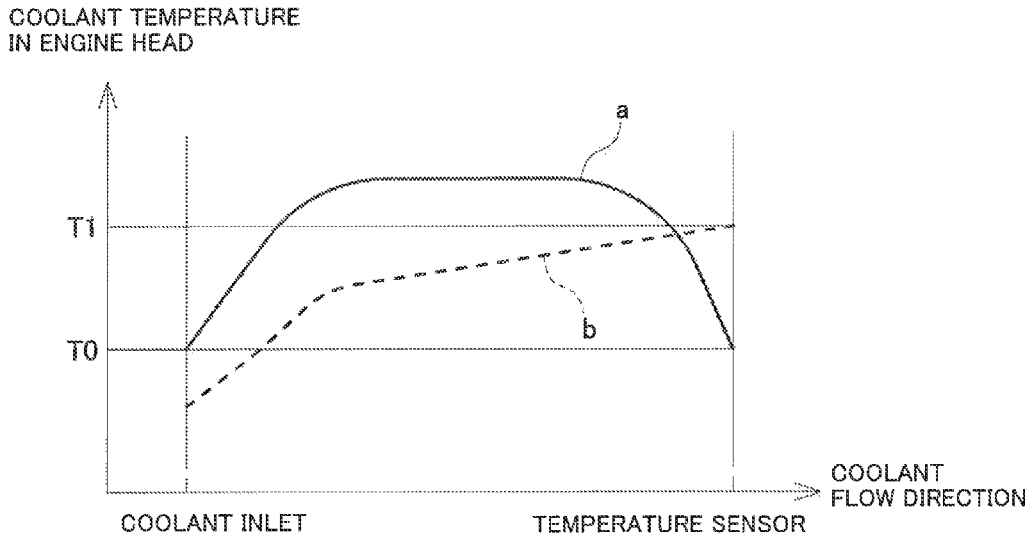
FIG. 2A is an explanatory diagram illustrating a distribution of coolant temperatures inside an engine head.
Figure 2B:
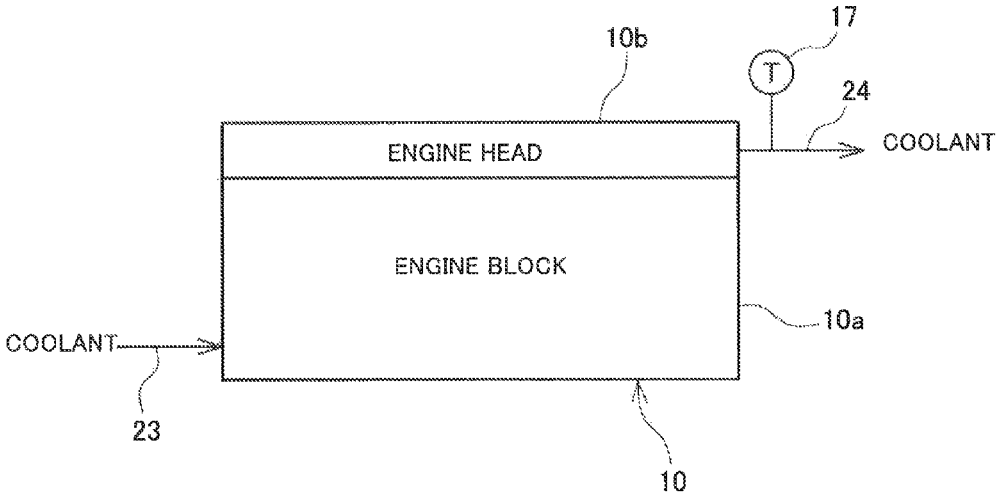
FIG. 2B is an explanatory diagram illustrating a flow of a coolant inside an engine block and an engine head, and a position of a temperature sensor.

The following describes, with reference to FIGS. 2A and 2B, how the coolant temperature inside the engine changes between a case where the coolant is flowing through the pore (micropore) 52 illustrated in FIG. 1 and a case where the coolant is not flowing through the micropore 52 because the pore is clogged. When the coolant flows through the micropore 52, the coolant flows into the inside of an engine block via the engine inlet pipe 23 illustrated in FIG. 2B, flows through an engine head illustrated in FIG. 2B, and then flows out to the outside of the engine head via the engine outlet pipe 24 connected to the engine head. As illustrated by a dashed line b in FIG. 2A, when the coolant flows into the inside of the engine 10, the temperature of the coolant is increased by the heat of the engine 10 and then keeps increasing slowly as it flows downstream. Then, the temperature of the coolant reaches a temperature T1 at the position of the temperature sensor 17 provided at the engine outlet pipe 24. On the other hand, when the coolant does not flow through the inside of the engine 10 due to the clogged pore (micropore) 52, the temperature of the coolant settling inside the engine 10 is increased by the heat of the engine 10 as illustrated by a solid line a in FIG. 2A. In contrast, the temperature of the coolant settling in the vicinity of the engine outlet pipe 24, where the heat from the engine 10 has not been transmitted as much, does not increase largely, staying at a temperature T0 lower than the temperature T1 as illustrated in FIG. 2A. That is, the temperature of the coolant at the engine outlet pipe 24 after the cold start of the engine is lower in a case where the coolant does not flow inside the engine 10 (where the pore (micropore) 52 is clogged), than in a case where the coolant flows inside the engine 10 (where the pore (micropore) 52 is not clogged). The pore clogging determination apparatus 70 of the present embodiment tentatively determines clogging of the pore (micropore) 52 based on the above-described principle.

Hereinafter, operations of the pore clogging determination apparatus 70 according to the present embodiment will be described with reference to FIG. 3. As shown at step S101 in FIG. 3, the cold start of the engine 10 by the ECU 60 also starts the motor 15 for the coolant pump 14, thereby starting the coolant pump 14. As previously described with reference to FIG. 1, the thermostat 13 and the switching valve 50 are closed at the time of cold start of the engine. Accordingly, the coolant circulates as indicated by arrows in FIG. 1, in the order of the coolant pump 14, the discharge pipe 21, the first branch point 22, the engine inlet pipe 23, the engine 10, the engine outlet pipe 24, the third branch point 25, the pore (micropore) 52, the fourth branch point 31, the second branch point 28, and returns to the coolant pump 14. Simultaneously, the coolant circulates while bypassing the engine 10, in the order of the coolant pump 14, the first branch point 22, the second branch point 28, and back to the coolant pump 14.

Figure 3:
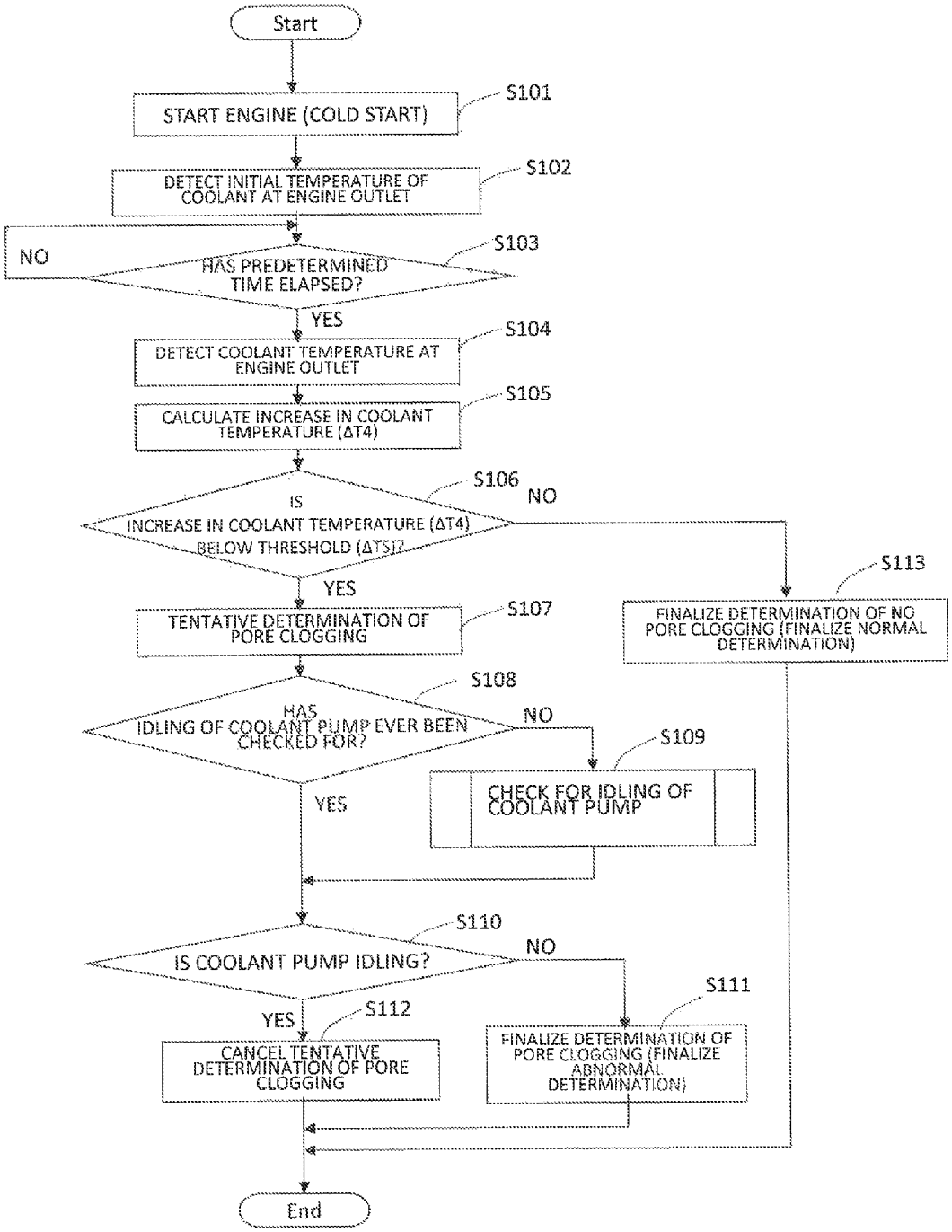
FIG. 3 is a flowchart illustrating an operation of a pore clogging determination apparatus according to an embodiment of the present invention.

As shown at step S102 in FIG. 3, the pore clogging determination apparatus 70, following the starting of the engine 10, detects an initial temperature T40 of the coolant in the engine outlet pipe 24 using the temperature sensor 17. Next, the pore clogging determination apparatus 70 waits until a predetermined time period has elapsed, as shown at step S103 in FIG. 3. The predetermined time period may be a time period needed for a coolant temperature T4 at the engine outlet to increase to a predetermine temperature when the pore (micropore) 52 is not clogged. This time period may be about three or five minutes, for example.

Figure 4A:
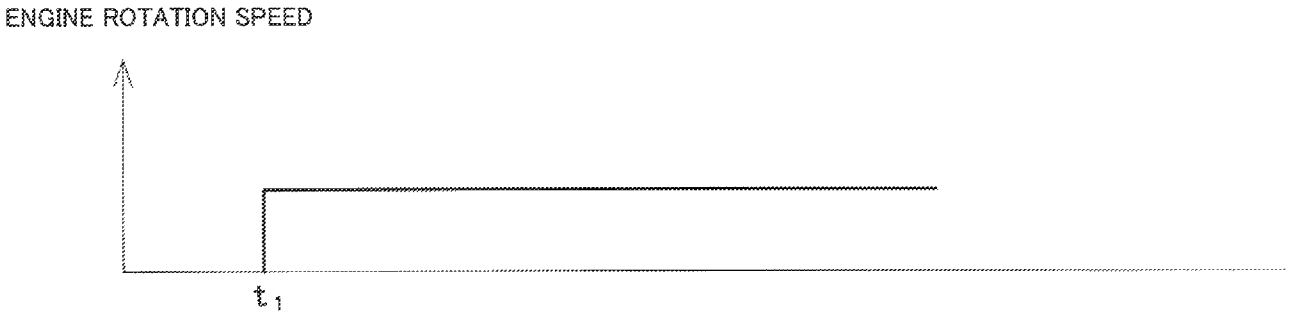
FIG. 4A is a graph illustrating a change with time of a rotation speed of an engine.
Figure 4B:
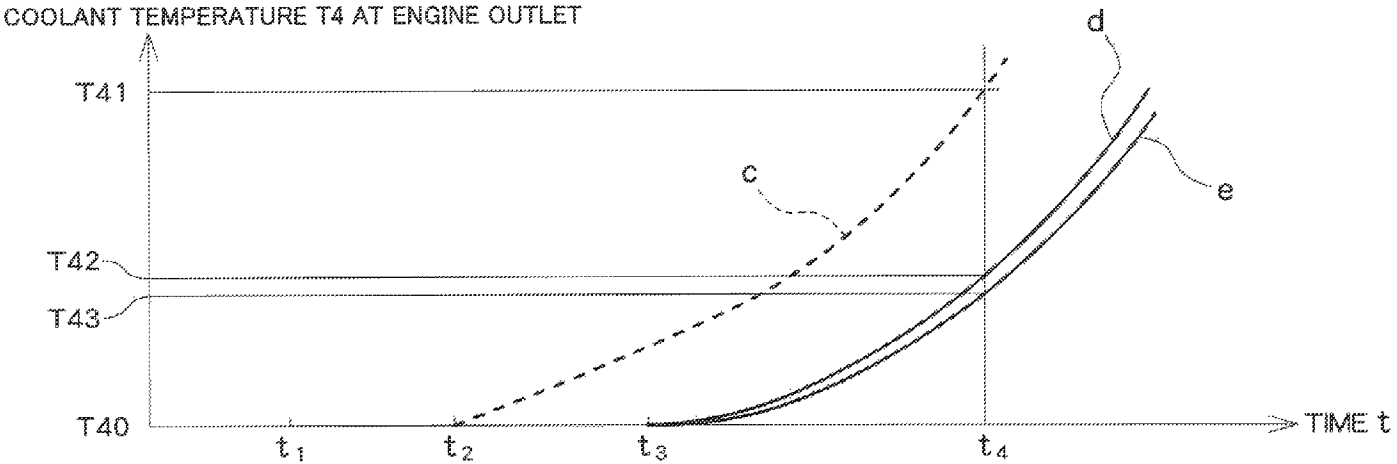
FIG. 4B is a graph illustrating a change with time of a coolant temperature T4 at an engine outlet when the engine is driven in a similar manner to FIG. 4A.

As illustrated in FIGS. 4A and 4B, after the cold start of the engine 10 at time t1, when the pore (micropore) 52 is not clogged and the coolant is flowing inside the engine 10 and the engine outlet pipe 24, the coolant temperature T4 at the engine outlet starts increasing at time t2 from the initial temperature 140, and keeps increasing to reach a temperature T41 at time t4 after the predetermined time period has elapsed, as illustrated by a dashed line c in FIG. 4B. In contrast, when the pore (micropore) 52 is clogged and the coolant is not flowing inside the engine 10 or inside the engine outlet pipe 24, the coolant temperature T4 at the engine outlet remains at the initial temperature T40 until time t3, and the temperature detected by the temperature sensor starts increasing at time t3 as illustrated by a solid line d in FIG. 4B. Thereafter, the temperature keeps increasing to reach a temperature T42 at the predetermined time t4. The temperature T42, however, is lower than the coolant temperature T41 at the engine outlet when the pore (micropore) 52 is not clogged. Also, as illustrated by a solid line e in FIG. 4B, when the first cooling passage 20 has no coolant therein or the time is immediately after injection of the coolant, the coolant pump 14 idles even with the motor 15 running. As a result, no coolant flows in the first and second cooling passages. Therefore, increase in the coolant temperature T4 at the engine outlet is delayed in a similar manner to the case where the coolant is not flowing due to the clogged pore (micropore) 52. That is, comparing the case where the pore (micropore) 52 is clogged and the case where the coolant pump 14 is idling, the rates of the temperature increase in the coolant temperature T4 at the engine outlet are substantially equal, as illustrated in the solid lines a and e in FIG. 4B.

The pore clogging determination apparatus 70 detects the coolant temperature T4 at the engine outlet again at time t4 after the predetermined time period has elapsed, as shown at step S104 in FIG. 3. The pore clogging determination apparatus 70 then calculates a temperature difference ΔT4=(T4−T40), which is the difference between the initial temperature T40 and the coolant temperature T4 at the engine outlet at the predetermined time t4, as shown at step S105 in FIG. 3. When the temperature difference ΔT4 is equal to or more than a predetermined threshold ΔTS (the case where ΔT4 is not less than ΔTS), the pore clogging determination apparatus 70 determines as NO at step S106 in FIG. 3 and then finishes executing the program based on a determination that the pore (micropore) 52 is not clogged (normal determination) as shown at step S113 in FIG. 3.

When the temperature difference ΔT4 is less than the predetermined threshold ΔTS at step S106 in FIG. 3, the pore clogging determination apparatus 70 determines as YES at step S106 in FIG. 3 and moves to step S107 in FIG. 3. As described above, the rates of the temperature increase with respect to the time in the coolant temperature T4 at the engine outlet are substantially equal between the case where the pore (micropore) 52 is clogged and the case where the coolant pump 14 is idling. Therefore, it is difficult at this stage to determine whether this is the case where actual clogging of the pore (micropore) 52 is occurring as illustrated by the solid line a in FIG. 4B or the case where the idling coolant pump 14 is hindering the coolant from flowing through the pore (micropore) 52 as illustrated by the solid line e in FIG. 4B, even with the presence of the delayed increase in the coolant temperature T1 at the engine outlet. Therefore, the pore clogging determination apparatus 70 tentatively determines that the pore (micropore) 52 is clogged and then moves to step S108 in FIG. 3.

The pore clogging determination apparatus 70 checks whether idling of the coolant pump 14 has ever been checked for as shown at step S108 in FIG. 3. In the case where idling in the coolant pump 14 has been checked for once, the pore clogging determination apparatus 70 moves to step S110 of FIG. 3. When no idling in the coolant pump 14 is detected on that occasion, the pore clogging determination apparatus 70 determines that the first and second cooling passages 20 and 30 are filled with the coolant and that the delayed increase in the coolant temperature T4 at the engine outlet has been caused by the clogged pore (micropore) 52 at the switching valve 50. The pore clogging determination apparatus 70 finalizes a pore clogging determination, namely, an abnormal determination, as shown at step S111 of FIG. 3, and then displays a failure indication on a diagnostic device or the like. When idling of the coolant pump 14 is detected on that occasion, on the other hand, the pore clogging determination apparatus 70 moves to step S112 in FIG. 3 and cancels the tentative determination of pore clogging made at step S107 in FIG. 3, not displaying any failure indication on the diagnostic device.

Meanwhile, when it is determined at step S108 in FIG. 3 that idling of the coolant pump 14 has not been checked for, the pore clogging determination apparatus 70 executes a process for checking for idling of the coolant pump shown in step S109 in FIG. 3. The pore clogging determination apparatus 70 outputs, to the ECU 60 illustrated in FIG. 1, a signal to increase the drive duty ratio or a signal to increase the rotation speed command value (target rotation speed) of the motor 15 for the coolant pump 14. Simultaneously, the pore clogging determination apparatus 70 obtains, from the ECU 60, the increased drive duty ratio or the increased rotation speed command value (target rotation speed) for the motor 15. Also, the pore clogging determination apparatus 70 obtains the actual rotation speed of the motor 15 by using the rotation speed sensor 16. The pore clogging determination apparatus 70 compares both values, and when the actual rotation speed of the motor 15 is more than the rotation speed command value (target rotation speed), and the difference between the two exceeds a predetermined threshold ΔRS, determines that the coolant pump 14 is idling. On the other hand, when the difference between the actual rotation speed of the motor 15 and the rotation speed command value (target rotation speed) does not exceed the predetermined threshold ΔRS, the pore clogging determination apparatus 70 determines that the coolant pump 14 is not idling. Subsequently, when the coolant pump 14 is idling, the pore clogging determination apparatus 70 determines as YES at step S110 in FIG. 3, and moves to step S112 in FIG. 3, where the apparatus cancels the tentative determination of pore clogging made at step S107 in FIG. 3, not displaying any failure indication on the diagnostic device. In contrast, when the coolant pump is not idling, the pore clogging determination apparatus 70 determines as NO at step S110 in FIG. 3, and moves to step S111 in FIG. 3 to finalize the pore clogging determination (abnormal determination) and then displays a failure indication on the diagnostic device or the like.

As described above, when determining clogging of the pore 52 based on the rate of increase in the coolant temperature T4 at the engine outlet, the pore clogging determination apparatus 70 of the present embodiment initially checks whether the delayed increase in the coolant temperature T4 at the engine outlet has been caused by the idling of the coolant pump 14 and then finalizes the abnormality determination of the pore clogging, making it possible to suppress an erroneous determination of the pore clogging and enhance reliability of the pore clogging determination.

In the above-described embodiment, the clogging of the pore (micropore) 52 has been determined based on whether the temperature difference ΔT4 between the coolant temperature T4 at the engine outlet at a predetermined time t4 and the initial temperature T40 is equal to or more than the predetermined threshold ΔTS. Alternatively, the clogging of the micropore 52 may be determined, for example, by comparing a temperature increase rate per predetermined time period (ΔT4/(t4−0)) and a predetermined temperature increase rate.

The invention claimed is:

1. A pore clogging determination apparatus to be used in an engine cooling system, the engine cooling system comprising:

a first cooling passage passing through the inside of an engine;

a second cooling passage branching from the first cooling passage and bypassing the engine;

a coolant pump controlled by a command from an ECU and configured to circulate a coolant in the first and second cooling passages;

a connection passage connecting an engine outlet of the first cooling passage to the second cooling passage;

a switching valve disposed in the connection passage, configured to open and close the connection passage, and including a pore that allows the coolant to flow through the connection passage; and a first temperature sensor configured to detect a coolant temperature at the engine outlet, wherein the pore clogging determination apparatus comprises a CPU and is connected to the ECU, when increase in the coolant temperature at the engine outlet is below a predetermined threshold at a predetermined time point after the time of a cold start of the engine, the coolant temperature being detected by the first temperature sensor, the CPU outputs, to the ECU, a command for increasing a rotation speed of the coolant pump to increase the rotation speed of the coolant pump, with the above state, the CPU determines whether or not the coolant pump is idling, and upon determining that the coolant pump is not idling, the CPU determines that the pore is clogged.

2. The pore clogging determination apparatus according to claim 1, wherein the CPU determines that the coolant pump is idling when an actual rotation speed of the coolant pump obtained by a rotation speed sensor higher than a target rotation speed obtained from the ECU, and a difference therebetween exceeds a predetermined value.

3. A pore clogging determination method to be used in an engine cooling system, the engine cooling system comprising:

a first cooling passage passing through the inside of an engine;

a second cooling passage branching from the first cooling passage and bypassing the engine;

a coolant pump configured to circulate a coolant in the first and second cooling passages;

a connection passage connecting an engine outlet of the first cooling passage to the second cooling passage;

a switching valve disposed in the connection passage, configured to open and close the connection passage, and including a pore that avows a very small amount of coolant to flow through the connection passage; and a first temperature sensor configured to detect a coolant temperature at the engine outlet, wherein when increase in the coolant temperature at the engine outlet is below a predetermined threshold at a predetermined time point after the time of a cold start of the engine, the coolant temperature being detected by the first temperature sensor, a command for increasing a rotation speed of the coolant pump is output to the ECU to increase the rotation speed of the coolant pump, with the above state, whether or not the coolant pump is idling is determined, it is determined that the pore is clogged when it has been determined that the coolant pump is not idling.

* * * * *